US005369560A

United States Patent [19]

Friedman

[11] Patent Number: 5,369,560

[45] Date of Patent: Nov. 29, 1994

[54] ACCESSORY CLIP FOR PORTABLE LIGHT

[76] Inventor: Arthur S. Friedman, 2144 Seneca West, Merrick, N.Y. 11566

[21] Appl. No.: 59,860

[22] Filed: May 11, 1993

[51] Int. Cl.[5] ..... F21V 21/00

[52] U.S. Cl. ..... 362/396; 362/190; 362/200

[58] Field of Search ..... 362/396, 85, 109, 190, 362/191, 200

[56] References Cited

U.S. PATENT DOCUMENTS

| | | | |
|---|---|---|---|
| 990,856 | 5/1911 | Freiberg | 362/396 |
| 1,037,096 | 8/1912 | Wood et al. | 362/396 |
| 1,427,532 | 8/1922 | Hambrock | 362/396 |
| 4,521,831 | 6/1985 | Thayer . | |
| 4,581,684 | 4/1986 | Mazzucco | 362/183 |
| 4,823,241 | 4/1989 | Trattner . | |
| 4,974,129 | 11/1990 | Grieb et al. . | |
| 5,169,226 | 12/1992 | Friedman . | |

*Primary Examiner*—Richard R. Cole

*Attorney, Agent, or Firm*—Dennison, Meserole, Pollack & Scheiner

[57] ABSTRACT

An accessory clip including an elongate planar base panel, an upstanding end panel integral with one end of the base panel, and a top panel integral with the end panel and overlying the base panel in upwardly spaced substantially parallel relation thereto. The top panel is of a substantially lesser length than the base panel. The base panel is selectively engageable beneath an elongate portable light both longitudinally coextensive therewith in a stored position, and transversely thereof in a use position wherein the base panel extends substantially laterally beyond the light. The clip is frictionally engaged with the light in both positions.

6 Claims, 1 Drawing Sheet

ACCESSORY CLIP FOR PORTABLE LIGHT

BACKGROUND OF THE INVENTION

Portable desk lights, as best exemplified by applicant's U.S. Pat. No. 5,169,226, have been found highly practical as a means for providing illumination in many different work environments, including conventional permanent work areas as in offices, and more unusual areas as in airplanes and the like.

However, in view of the lightweight and compact nature of such portable desk lights, a valuable feature in providing the desired portability, difficulties are occasionally encountered in stabilizing the light adjacent the work area. While this would not be a problem working on a desk or table at home or in the office, it could be a problem in a moving vehicle, as for example when using a laptop computer on an airplane seat tray or actually on one's lap, possible with an attache case providing a more rigid support surface.

SUMMARY OF THE INVENTION

The object of the present invention is to provide a means for temporarily stabilizing a portable desk light in working relationship to a laptop computer or the like. The portable light itself is a compact unit utilizing batteries as a source of power and normally a single bulb for illumination provided in the adjustable outer end of an extensible arm as noted in applicant's U.S. Pat. No. 5,169,226.

It is significant that the compact portable nature of the light be maintained, notwithstanding the addition of means for providing the desired stability.

The invention herein comprises an accessory clip which removably mounts directly to the portable light in a stored position and in a use position. In the stored position the clip, which is formed of rigid thin sheet-like material, is for the most part concealed below the bottom of the light and is secured thereto by partially encircling one end of the light. The additional weight added to the portable light is negligible, as is the increase in the length and thickness of the light. Thus, the portable light, even with the accessory clipped thereto as a valuable additional component, retains all of its desirable features. In conjunction therewith, it is significant that the clip, mounted to the light, in no way interferes with the use of the portable light, including the ability of the light to adjust and change the position of the illuminating bulb relative to the battery case which defines the body of the light.

The accessory clip includes a base or base panel which is of a substantially greater length than width and which corresponds to the configuration of the bottom of the portable light. So configured, the base panel, in the stored position noted above, is easily concealed beneath the light.

In the use position, the clip is mounted transverse to the portable light, and is clipped to the battery case generally centrally along one longitudinal edge of the battery case. So positioned, the greater length of the base panel results in a substantial extension of the panel beyond the opposed side edge of the light. This extending portion of the base panel is positioned between the support surface and the computer or similar type of equipment utilized. In this manner, the clip is stabilized and the portable light fixed immediately adjacent to the mounted equipment for illumination of the keyboard or the like.

The accessory clip, in addition to the elongate base or base panel, includes an upwardly projecting end wall or panel and a top panel substantially paralleling the base panel and at a height relative thereto as to provide for a frictional gripping of the battery case. The top panel is so dimensioned as to, when overlying the top of the battery case, not interfere with the operating components of the light, for example the lamp-mounting pivoting extensible arm.

Other features, objects and advantages of the invention will be recognized from the more detailed description of the invention following hereinafter.

DESCRIPTION OF PREFERRED EMBODIMENT

Figure 1:
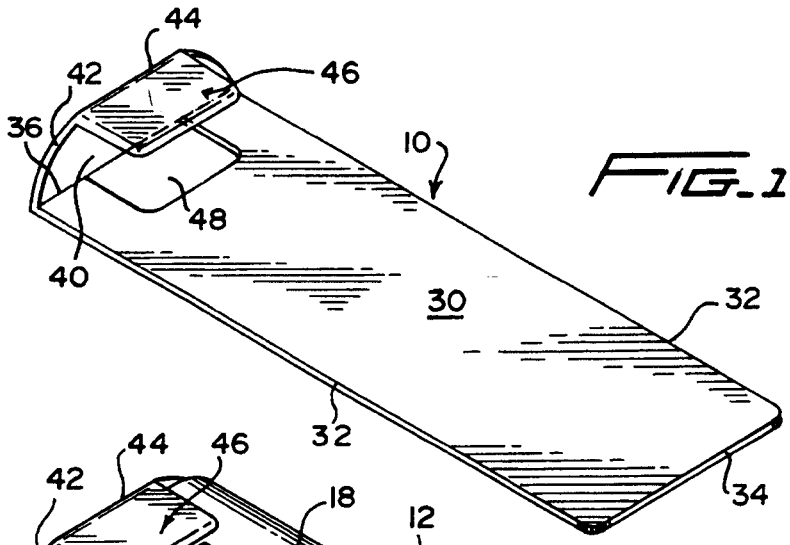
FIG. 1 is a perspective view of the accessory clip.

The accessory clip 10 of the invention is particularly adapted to accommodate an elongate compact portable desk light 12. The desk light 12, in a preferred form, includes an elongate rectangular bottom or bottom panel 14 with an elongate rectangular battery case 16 extending along a major portion thereof. The battery case 16 has a planar top surface 18, a flat rear end wall 20, and opposed longitudinal sides or side walls 22.

An elongate extensible support arm 24 is recessed within a central channel in the battery case and is selectively upwardly pivoted to an operative position. A lamp housing 26 pivotally mounts to the upper end of the support arm 24 and is adjustable as suggested in FIG. 4. The completely collapsed position of the light will be best seen in FIG. 2 wherein it will be appreciated that the bottom panel 14 projects forwardly of the battery case 16 a distance sufficient to accommodate the nested lamp housing 26. The length of the light 12 is defined by the length of the bottom panel 14. The height of the compacted or closed light is defined by the height of the battery case 16 with the closed lamp housing 26 possibly projecting minimally thereabove. The width of the compact desk light is defined by the width of the bottom 14 and the battery case 16 between the side walls 22.

Turning now to the accessory clip 10, this clip includes an elongate planar base or base panel 30 having opposed elongate parallel side edges 32, a free outer edge 34 and an inner edge 36.

An inner end wall or panel 40 has the lower edge thereof integral or otherwise rigid with the inner edge 36 of the base 30, with the end panel 40 projecting upwardly or substantially perpendicular to the base 30. As illustrated, the end panel 40 at the joinder with the base 30 is of equal width thereof. The outer edge of the end panel 40 includes opposed side edge portions 42 which arc upwardly toward each other and terminate in a central longitudinal upper or outer edge extent 44.

A top panel 46 is integral with or otherwise rigidly affixed to the central extent 44 of the end panel 40 and projects forwardly therefrom in vertically spaced overlying relation to the base 30. The top panel 46 is of a length, forward from the end panel 40, substantially less than that of the length of the base 30. Similarly, the width of the top panel 46 is preferably less than the corresponding width of the base between the opposed side edges 32 thereof.

The base 30, vertically aligned with the top panel 46, includes an open area 48 extending inwardly relative to the end panel 40. This opening 48 reduces the amount of material required for manufacture of the clip 10 and reduces the weight of the clip without affecting the structural integrity thereof. Further, if the clip 10 is to be molded of an appropriate synthetic resinous material or plastic, the provision of this opening 48 will facilitate formation of the clip, in particular the top panel 46.

The clip is to be substantially rigid with the material of the clip having an inherent slight degree of flexible resiliency to accommodate mounting of the clip to and in frictional clamping engagement with the portable desk light 12. The thickness of the individual panels of the clip, all of which are planar, will be approximately 1/16 to 1/8 inch.

Figure 2:
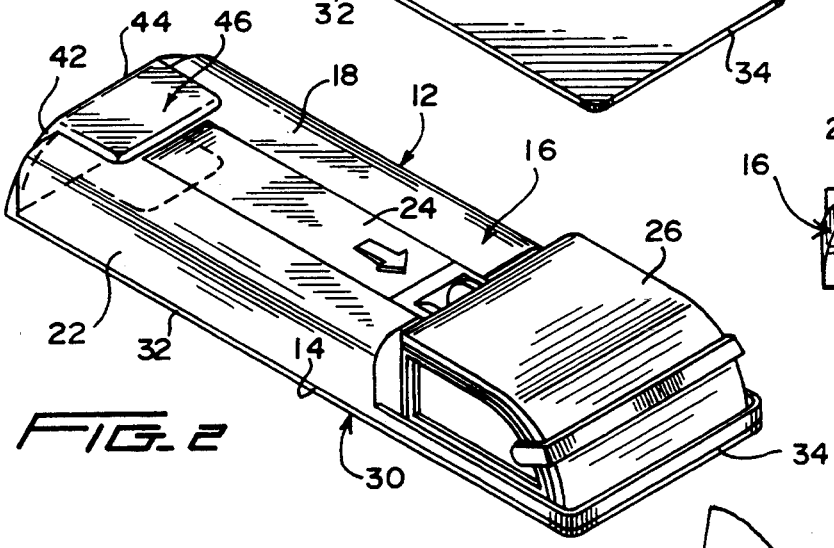
FIG. 2 is a perspective view of the accessory clip mounted in the stored position on a portable light and illustrating the length and width relationship therebetween.
Figure 3:
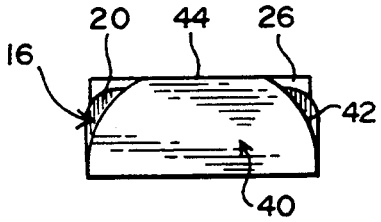
FIG. 3 is an end view of the accessory clip mounted in the stored position on a portable light.

Noting FIGS. 2 and 3, the length and width of the base panel 30 of the clip 10 are preferably substantially equal to the length and width of the bottom 14 of the portable light 12. While the dimensions of the base panel 30 may be slightly less than those of the bottom panel 14, they should be no greater. Thus, the clip panel 30, in the stored position of the clip, will underlie the bottom panel 18 of the light and not project therebeyond.

The end panel 40 of the clip is of a height substantially equal to the height of the battery case 16 and dimensioned to overlie the end wall 20 of the battery case without projecting laterally therebeyond. In fact, as noted in FIG. 3, the arcuate edge portions 42 of the end panel 40 are of a greater curvature than the corresponding portions of the battery case end wall 20 whereby opposed corner portions of the end wall 20 are exposed.

The top panel 46 of the clip 10, with the clip in its stored position of FIGS. 2 and 3, overlies the top surface 18 of the battery case. The length of the top panel 46 is sufficient to properly engage the battery case while terminating short of the extensible support arm 24 so as to not interfere with the free operational movement thereof. Further, the vertical height between the clip base 30 and the top panel 46 thereof is such as to provide for a positive frictional engagement of the battery case therebetween, normally through a slight flexing of the accessory clip which is achieved through the inherent flexible resiliency of the material of the clip.

When the clip 10 is mounted in its stored position, as in FIGS. 2 and 3, the length of the portable desk light is increased only by the thickness of the end panel 40. Similarly, the height of the portable light is, for a major portion of the length thereof, increased only by the thickness of the base panel 30. At the mounting end of the accessory clip 10, the overall thickness is increased by the combined thickness of the base panel 30 and the top panel 46. The additional height added by the thickness of the top panel 46 generally corresponds to the slight distance which the lamp housing 26, in its closed position, projects above the battery case 16.

Figure 4:
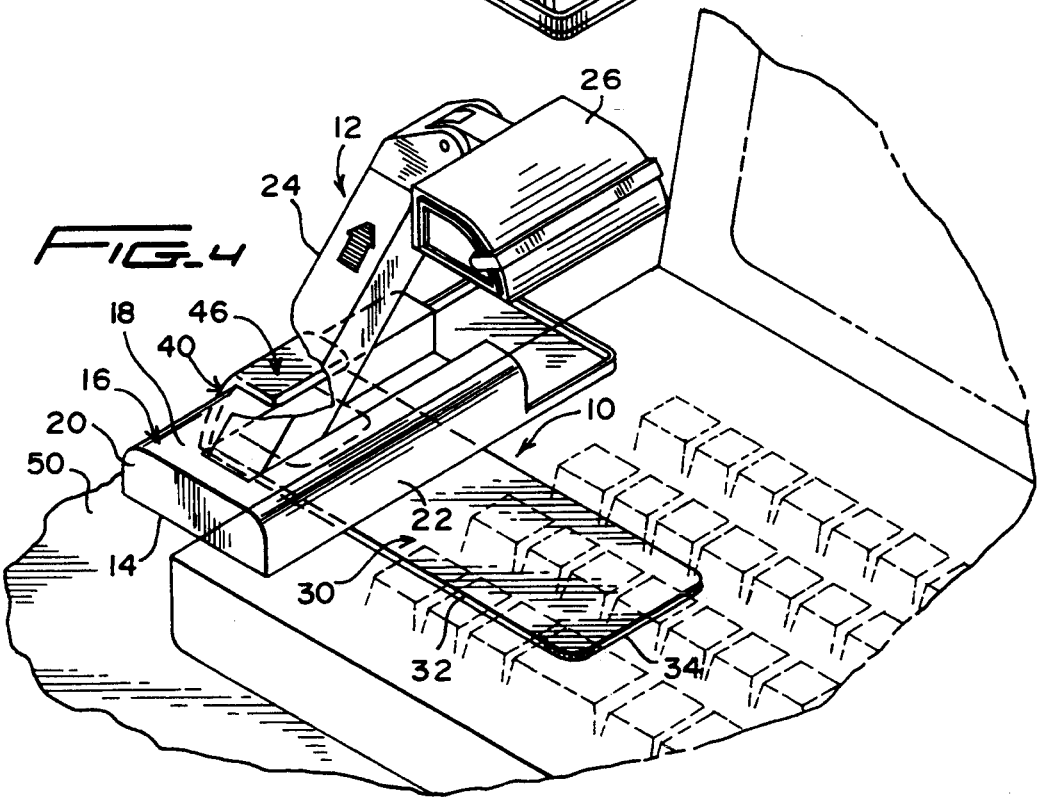
FIG. 4 is a perspective view of the accessory clip mounted in its use position to a portable light for retention of the light adjacent a work area, for example a laptop computer as illustrated.

Noting FIG. 4, the use position of the accessory clip 10 comprises a positioning of the clip 10 transversely across the light 12. In this position, the clip base panel 30 underlies the battery case with the end panel 40 engaged against one longitudinal side wall 22 of the battery case, and the top panel 46 overlying the top face 18 of the battery case. The base panel 30 underlying the bottom panel 18 of the battery case extends substantially beyond the opposed side wall 22.

Inasmuch as the light 12 and the accessory base panel 30 are substantially longer than wide, the extension of the base panel 30 beyond the side 22 of the battery case 16 in the mounted position of the accessory clip 10 is substantial. This extending portion engages beneath any appropriate work piece, for example, the illustrated laptop computer, a clipboard or the like. So positioned, the accessory clip is retained between the computer and the underlying support surface 50, for example a desk top. The light 12, in turn, is effectively clamped into position and can be appropriately extended to illuminate the keyboard. It will be appreciated that the longitudinal extent of the top panel 46 terminates short of the extensible support arm 24 for the lamp housing 26, and thus does not interfere with movement of the support arm. In addition, inasmuch as the thickness of the battery casing is substantially constant, the accessory clip 10 will also effectively frictionally engage the battery case 14 between the base panel 30 and the top wall 46 in the use position of the clip as in FIG. 4.

From the foregoing, it will be appreciated that a unique accessory clip has been defined which is particularly adapted for use with a compact portable desk light as a means for stabilizing the light in operative position adjacent a laptop computer or the like. Of particular significance is the ability of the accessory clip to mount in a stored position directly on the portable light in a manner which adds substantially no bulk thereto and has no practical effect on the compact nature of or portability of the light. Also, as has been discussed, the clip secures to the light, both in the stored and the use position in a manner which in no way interferes with use of the portable light, including full adjustment thereof.

The foregoing is illustrative of the principals of the invention.

I claim:

1. A portable light means and accessory clip therefor, said light means comprising an elongate case having a forward end and a rear end, opposed sides, a predetermined width between said sides, and a predetermined length between said ends substantially greater than said width, said light means further including lamp means mounted on said case, said case, at said rear end, extending rearward of said lamp means, said case, at at least one of said sides, extending laterally outward of said lamp means; said accessory clip, in a stored position, including a base panel longitudinally underlying and engaging said case and being within the peripheral confines thereof as defined by said forward and rear ends and said opposed sides, said clip including an end panel integral with said base panel and extending laterally of said base panel, and an overlying panel integral with and projecting laterally from said end panel in overlying relation to said base panel, said end panel and overlying panel engaging about said case rearward of said lamp means and clamping said case between said overlying panel and said base panel, said clip base panel being of a length greater than said width of said case; said base panel, in a use position for said accessory clip, transversely underlying and engaging said case, said end panel and said overlying panel engaging about said case to said side of said case extending laterally outward of said lamp means and clamping said case between said overlying panel and said base panel, said base panel extending laterally beyond the side of said case opposed to said engaging end panel and said engaging overlying panel.

2. The assembly of claim 1 wherein said clip base panel has forward and rear ends and opposed longitudinal edges substantially coextensive respectively with the forward and rear ends and opposed sides of said case in said stored position, said overlying panel of said clip being of a length less than said length of said base panel.

3. The assembly of claim 2 wherein said overlying panel is of a width less than said width of said case, said end panel having an outer edge including a linear central portion whereat said overlying panel is integral with said end panel, and opposed side portions, said side portions each define an arc from said central portion to a corresponding base panel longitudinal edge.

4. A portable light means and accessory clip therefor, said light means being elongate and having a forward end and a rear end, opposed sides, a predetermined width between said sides, and a predetermined length between said ends substantially greater than said width, said light means including an adjustable support arm and lamp, said light means, at said rear end, extending rearward of said support arm, said light means, at each of said sides, extending laterally outward of said support arm; said accessory clip, in a stored position, including a base panel longitudinally underlying and engaging said light means and being within the peripheral confines thereof as defined by said forward and rear ends and said opposed sides, said clip including an end panel integral with said base panel and extending laterally of said base panel, and an overlying panel integral with and projecting laterally from said end panel in overlying relation to said base panel, said end panel and overlying panel engaging about said light means rearward of said support arm and clamping said light means between said overlying panel and said base panel, said clip base panel being of a length greater than said width of said light means; said base panel, in a use position for said accessory clip, transversely underlying and engaging said light means, said end panel and said overlying panel engaging about said light means laterally to one side of said support arm and clamping said light means between said overlying panel and said base panel, said base panel extending laterally beyond the side of the light means opposed to said engaged end and overlying panels.

5. The assembly of claim 4 wherein said clip base panel has forward and rear ends and opposed sides substantially coextensive respectively with the forward and rear ends and opposed sides of said light means in said stored position.

6. The assembly of claim 4 wherein said overlying panel of said clip is of a length less than said length of said base panel.

* * * * *